United States Patent [19]

Gurth

[11] Patent Number: 4,940,385

[45] Date of Patent: Jul. 10, 1990

[54] ROTARY DISC PUMP

[76] Inventor: Max I. Gurth, 1781 Carob Tree La., El Cajon, Calif. 92021

[21] Appl. No.: 343,536

[22] Filed: Apr. 25, 1989

[51] Int. Cl.[5] ..... F01D 1/36

[52] U.S. Cl. ..... 415/206; 415/90

[58] Field of Search ..... 415/90, 206, 227, 211.1, 415/208.4, 143, 86, 87, 198.1

[56] References Cited

U.S. PATENT DOCUMENTS

| | | | |
|---|---|---|---|
| 1,013,248 | 2/1912 | Wilkinson . | |
| 1,056,338 | 3/1913 | Johnsen | 415/90 |
| 1,779,201 | 10/1930 | Wickstrom | 415/206 |
| 1,793,179 | 2/1931 | Lanterman et al. | 415/90 |
| 4,255,081 | 3/1981 | Oklejas et al. | 415/90 |
| 4,335,994 | 6/1982 | Gurth | 415/90 |
| 4,421,412 | 12/1983 | Hold et al. | 415/90 |
| 4,514,139 | 4/1985 | Gurth | 415/90 |
| 4,768,920 | 9/1988 | Gurth | 415/90 |
| 4,773,819 | 9/1988 | Gurth | 415/90 |

OTHER PUBLICATIONS

*Wemco Catalog,* pp. 4 and 5; "Wemco Model C Pump", no date given.

*Fluid Handling,* Apr. 1988 Process Engineering—"-Pump Those Fluids", pp. 3 and 4.

*Fluid Handling,* Apr. 1988 Chemical Processing—"Disc Pump Design Handles Difficult Slurries", pp. 119 and 120.

*Primary Examiner*—Carl D. Price

*Assistant Examiner*—Hoang Nguyen

*Attorney, Agent, or Firm*—Brown, Martin, Haller & McClain

[57] ABSTRACT

A rotary disc pump comprises an outer housing with an inner cylindrical rotor chamber having an inlet at one end and an outlet at its outer periphery. A rotor assembly in the chamber comprises at least two parallel spaced discs disposed co-axially in the chamber and connected together for rotation about their center axis. The inner opposing faces of the discs are spaced a predetermined distance apart, and a series of raised ribs or vanes are provided on at least one of the opposing faces, with the vane height being less than the disc spacing to leave a clearance between the opposing disc surfaces.

14 Claims, 2 Drawing Sheets

ROTARY DISC PUMP

BACKGROUND OF THE INVENTION

The present invention relates generally to fluid pumps and is particularly concerned with rotary disc pumps in which a plurality of rotating discs are used to pump fluid.

Rotating disc pumps of this general type are described in my U.S. Pat. Nos. 4,768,920 and 4,773,819. In both patents, a pump is described which comprises a plain disc impeller with a substantially unobstructed passage between the inlet and outlet of the pump. The fluid is pumped through the pump by means of friction or viscous drag and shear forces created by the rotating discs. The open design of the pump, with clearances between the opposing flat disc faces, allows fragile materials or articles carried along in a fluid stream to be pumped, which would not be possible in more conventional vaned rotor pumps in which the vanes act as impellers forming a channel for the fluid. The plain disc pump is suitable for pumping both fragile and severely abrasive materials, highly viscous fluids, and fluids with a high solids content, which would otherwise cause damage to close-fit impellers and vanes on more traditional vaned or bladed rotor pumps. However, the plain disc pump has a lower flow rate and efficiency than a bladed rotor pump.

SUMMARY OF THE INVENTION

It is an object of this invention to provide an improved rotary disc pump.

According to the present invention, a rotary disc pump is provided which comprises a housing having an inner cylindrical rotor chamber, with an inlet at one end of the the chamber and an outlet at the outer periphery of the chamber, and at least two parallel, spaced discs disposed coaxially in the rotor chamber and connected together for rotation about their center axis, the opposing faces of the discs being spaced apart a predetermined distance and at least one of the opposing faces having a plurality of raised vanes, the height of the vanes being less than the spacing between the discs.

In the preferred embodiment of the invention, radially extending vanes are provided on both of the opposing disc faces and the combined vane height is less than the disc spacing, so that there is still a clearance between the opposing edges of the vanes.

Two or more rotary discs may be provided in the rotor chamber, with vanes on all the opposing disc faces. The disc at one end of the chamber has a central opening aligned with the inlet, while the disc at the opposite end of the chamber is secured to a drive assembly for rotating the discs and comprises a drive plate. Where there are more than two discs, all of the discs except the drive plate will have central openings. The drive plate may also be provided with vanes on its outer face for pumping out any fluid trapped behind the drive plate.

Preferably, the height of the vanes on each of the opposing disc faces is around 25% of the spacing between the discs. This provides sufficient clearance between the opposing vanes to provide the desired material handling properties, in most cases. The vane structure enhances the efficiency of the pump and results in higher flow rates and discharge pressures than comparably sized plain or flat disc designs. The spacing or clearance between the opposing disc faces or vanes allows handling of fluids carrying solids, entrained air or gas, or stringy materials with little or no risk of clogging The increased efficiency allows the selection of smaller pumps and lower energy motors for equivalent applications.

In a preferred embodiment of the invention, a plurality of equally spaced, radially extending straight vanes are provided on each of the opposing disc faces, with the opposing vanes being aligned The vanes preferably extend from the outer periphery of the disc towards its center. The vanes may stop at a central opening in the disc, or all stop on a circle of predetermined radius on the disc Alternatively, some vanes may be longer than others. The vanes may all be of equal thickness, or alternating thicker and thinner vanes may be provided Any desired number of vanes may be provided, according to the specific application, with a greater number of vanes generally resulting in higher pressure and higher total dynamic head. The vanes may be straight rectangular bars or ribs welded to the flat surface of the disc The vanes increase the viscous drag which transfers momentum to the fluid being pumped.

The vaned rotary disc pump therefore has equivalent advantages to the flat rotary disc pump, although its material handling properties are not as good, and it cannot handle extremely abrasive or shear sensitive materials, provides significantly improved pumping efficiency over a flat rotary disc pump of equivalent dimensions and has better material and solid handling, and greater stability, than a standard centrifugal pump.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
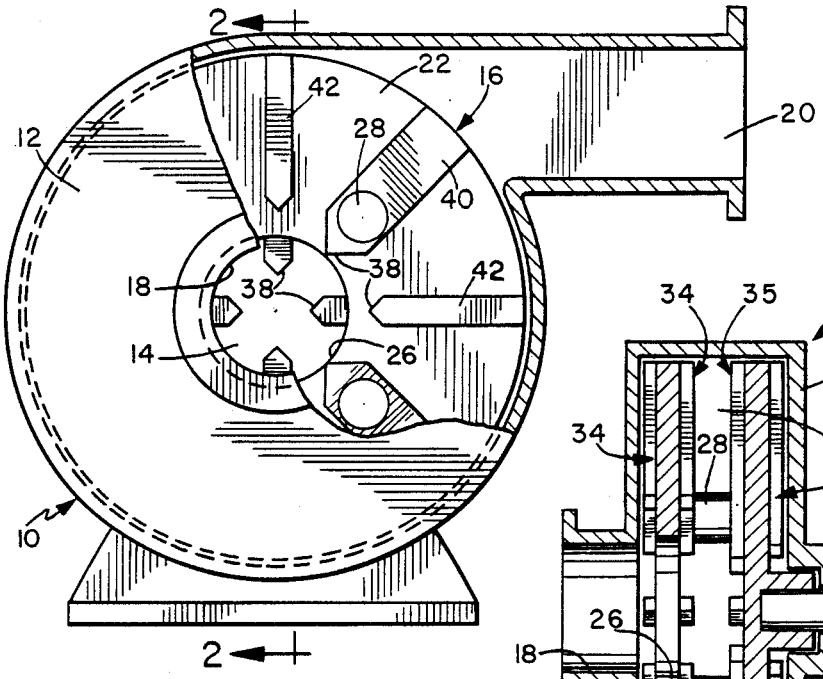
FIG. 1 is a side elevation view, partially cut away, of a pump unit according to a first embodiment of the invention.
Figure 2:
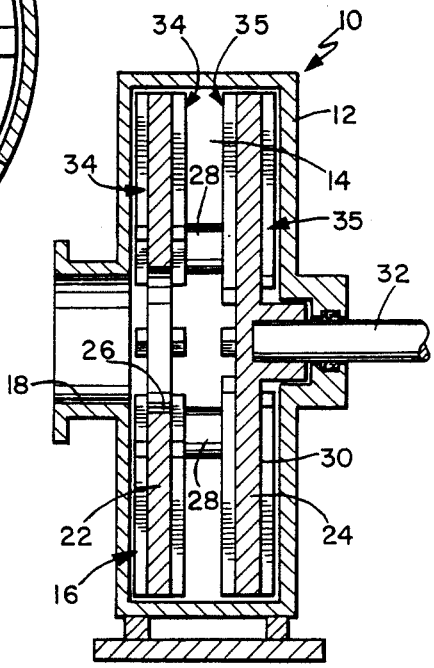
FIG. 2 is a sectional view taken on line 2—2 of FIG. 1.

FIGS. 1 and 2 of the drawings illustrate a rotary disc pump 10 according to a first embodiment of the invention for pumping various types of fluids, including relatively abrasive slurries or fluids having solid contents, highly viscous fluids, and fluids having entrained gas contact. The pump basically comprises a housing 12 having an inner cylindrical rotor chamber 14 in which a rotor assembly 16 for pumping fluid through the pump is rotatably mounted. Chamber 14 has an inlet 18 at one end and an outlet 20 (see FIG. 1) extending generally tangentially from the outer periphery of the chamber.

Figure 3:
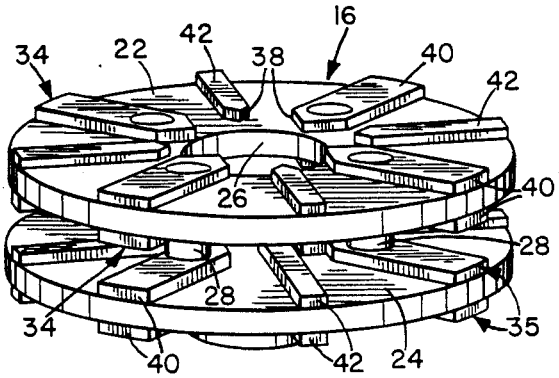
FIG. 3 is a perspective view of the rotor assembly of the pump.

The rotor assembly 16 is best illustrated in FIGS. 2 and 3 and comprises a pair of parallel, spaced discs 22,24 disposed co-axially in the rotor chamber 14. The first disc 22 at the inlet end of the chamber has a central opening 26 aligned with inlet 18 for allowing fluid to flow from the inlet into the spacing between the discs. The first disc is connected to the second or drive disc 24 via a plurality of pins or connectors 28 spaced around and closely adjacent to the axis of the discs. The drive disc 24 is connected on its outer face 30 to a suitable drive shaft 32, which is connected to a motor (not shown) for driving the assembly.

Figure 4:
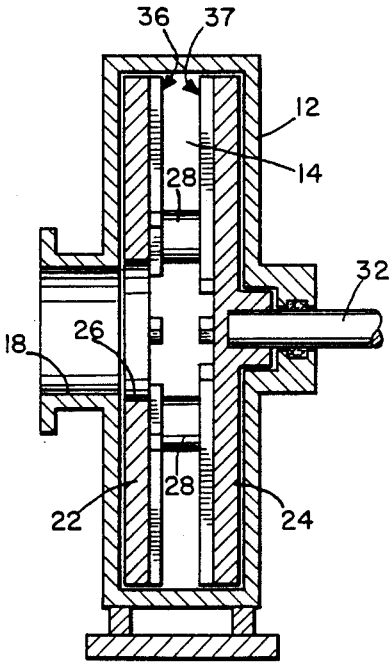
FIG. 4 is a view similar to FIG. 2, but with vanes only on the inner, opposed faces of the rotor discs.

Each disc 22,24 has a plurality of generally radially extending vanes or ribs 34,35 on each of its faces, which extend from the outer periphery of the disc towards its center, as illustrated in the drawings. In a preferred embodiment of the invention, the ribs 34,35 comprised bars of generally rectangular cross section welded to the opposite faces of each disc. Alternatively, in the modified rotor assembly illustrated in FIG. 4, vanes or ribs 36,37 may be provided only on the inner, opposing faces of the discs. The pump illustrated in FIG. 4 is otherwise identical to that of FIGS. 1 to 3, and like reference numerals have been used for like parts. In the embodiment illustrated in FIGS. 1 to 3, eight vanes are provided on each disc face at equal intervals, with the vanes 34,35 on the opposing disc faces being in alignment, as best illustrated in FIG. 3. However, a greater or lesser number of vanes may be provided, depending on the particular application, as explained in more detail below.

The discs 22,24 are spaced a predetermined distance apart, dependent on the characteristics of the fluid to be pumped, and the combined height of the opposing vanes on the inner faces of the discs is less than the disc spacing, so as to leave a fairly large gap between the opposing inner vanes, as best illustrated in FIG. 2. This gap will again depend on the characteristics of the fluid being pumped, but the height of each vane is preferably around 25% of the spacing between the discs. This has been found to enhance the efficiency of the pumping action as compared to a planar disc pump of equivalent dimensions while not compromising the material handling properties of the pump to an undesirable extent. Clearly, the material handling properties of the vaned disc pump illustrated will not be as great as those of a planar disc pump, so that extremely delicate or shear sensitive materials and severely abrasive fluids cannot be handled. However, the vaned disc pump can efficiently pump less delicate, sensitive or abrasive materials, and fluids with high solids or entrained gas contents, which are still unsuitable for conventional centrifugal impeller pumps having no clearances.

Although the pump illustrated in the drawings has only two discs, a rotor assembly having a greater number of discs may be provided in alternative versions, in a similar manner to that described in my U.S. Pat. No. 4,773,819 referred to above In general, a greater number of discs will increase the impelling force and thus the efficiency and pressure output of the pump. The discs will all be provided with straight radial vanes on their opposing faces, as in the two disc pump illustrated in FIGS. 1 to 3, with the height of the opposing vanes being less than the disc spacing. The outermost discs may have vanes on their outer faces as in FIGS. 1 to 3, or the outer faces may be flat as in FIG. 4. Rotor assemblies with any number of parallel discs from 2 to 8 or more may be provided, with the rotor assembly selected for any particular application depending on the characteristics of the fluid being pumped and the flow rates needed.

Preferably, the vanes or ribs are straight and of uniform width. The vanes extend up to or close to the center opening 26 in disc 22, and are of equivalent or slightly greater length on disc 24. The inner ends 38 of the vanes are preferably pointed or tapered as illustrated to provide more clearance for fluid to pass between the vanes where they converge together towards the center of each disc. The vanes may all be of substantially the same length and width, or alternating thicker and thinner vanes 40,42 may be provided as illustrated in FIGS. 1 and 3. Some or all of the vanes on the inner face of the drive plate may be longer than the corresponding vanes on the first plate 22, where the vane length is limited by the opening 26, as illustrated in FIG. 1. The thicker vanes on the opposite faces of first plate 22 extend up to the edge of opening 26, while the thinner vanes 42 terminate short of opening 26 to provide more clearance. This arrangement is reversed on the drive plate where the thinner vanes 42 are longer than the thicker vanes 40.

In the embodiment illustrated in FIGS. 1 and 2, the rotor assembly has vanes on the outer faces of both the disc at the inlet end of the rotor chamber and the drive disc 24. This may be useful in some applications since the vanes on the outer faces will tend to pump fluid trapped behind the outer discs back into the pumping area between the discs, which may be important with some types of fluids, for example highly viscous fluids. However, as discussed above, FIG. 4 illustrates an alternative embodiment in which vanes are provided only on the inner faces of the discs, and this version may be used where trapped fluid is not likely to cause a problem.

Figure 5:
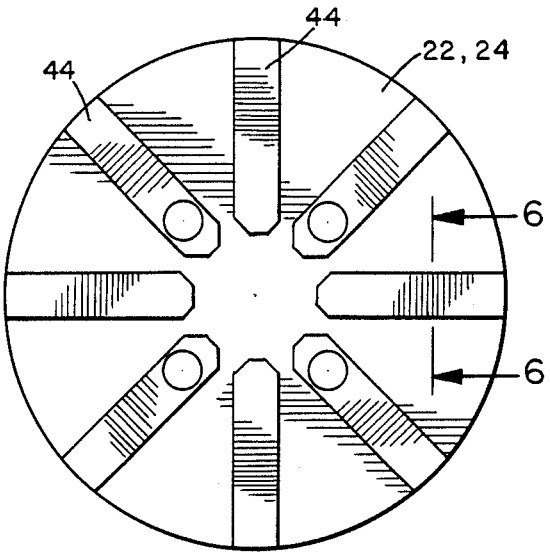
FIG. 5 is a face view of a rotor disc with an alternative vane arrangement.
Figure 6:
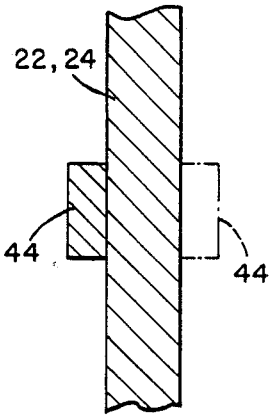
FIG. 6 is an enlarged sectional view taken on line 6—6 of FIG. 5.
Figure 7:
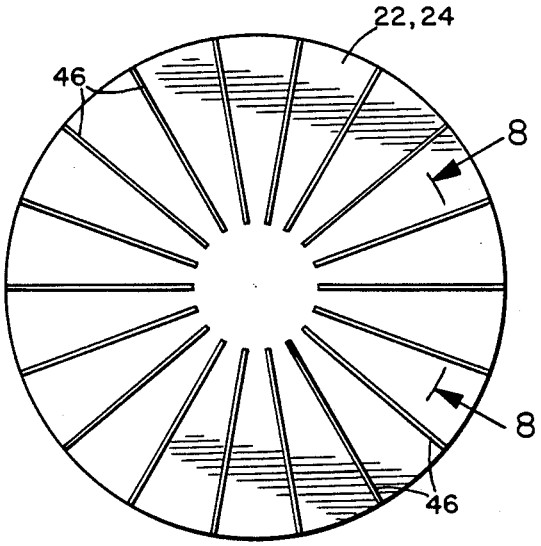
FIG. 7 is a face view of a rotor disc with a further vane configuration.
Figure 8:
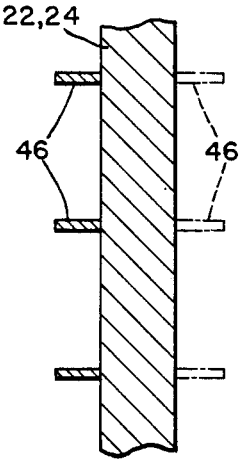
FIG. 8 is an enlarged sectional view taken on line 8—8 of FIG. 7.

Some other alternative vane configurations are illustrated in FIGS. 5 to 8. FIGS. 5 and 6 show equally spaced vanes 44 of equal length and thickness, and FIGS. 7 and 8 show an alternative in which a much larger number of relatively thin vanes 46 is provided. In general, any number of vanes may be provided with a larger number of vanes generally resulting in higher output pressure and higher total dynamic head. In fact, of the embodiments illustrated, the rib or vane configuration of FIG. 7 provides the greatest efficiency. Two or more discs having the vane configuration of either FIG. 5 or FIG. 7 may be used in place of the discs 22 and 24 in the pump arrangement illustrated in FIGS. 1 and 2, or that of FIG. 4 with vanes only on the internal, opposing disc faces.

In operation of the pump illustrated in FIGS. 1 to 3, the fluid enters the pump through inlet conduit and proceeds to the spacing between the opposing disc faces As the discs rotate, the fluid will proceed radially outwardly to the outer portions of the disc by a combination of friction and pressure gradients, and viscous drag, created by the rotating discs and enhanced by the action of the vanes, which add to the profile or form passing through the fluid and thus increase the form drag. The fluid is then discharged through outlet which will be located on an area of the peripheral wall of the chamber between the two discs. Preferably, the outlet extends substantially across the entire gap between the discs, as in the pump described in my U.S. Pat. No. 4,773,819 referred to above In one specific example of a vaned disc pump with discs of 10 inch diameter each having a vane configuration as illustrated in FIGS. 1 to 3, the spacing between the inner faces 50 of discs 22 and 24 was 1.25 inches, while each vane was around 0.25 inches in height. The thinner vanes were approximately 0.6 inches in width while the thicker vanes were wider to accommodate the connecting posts or pins 28 which extend through the alternate vanes and which were of approximately 1 inch diameter in this example. The length of the thinner vanes on the inner face of the first disc 22 in this example is less than that of the thicker vanes, which extend up to the periphery of the central opening 26, which has a diameter of about 3 inches. The thinner vanes were of the order of 3 inches in length, while the thinner vanes on the drive plate or disc were of the order of 4.3 inches in length The length of the thicker vanes on both discs was about the same. Where ribs or vanes are provided on both faces of each disc, the vanes on the opposing faces of each disc are preferably of identical configuration.

In one specific example of a vaned 10 inch disc pump having the configuration illustrated in FIG. 5, eight metallic vanes or bars of rectangular cross section as illustrated in FIG. 6 were welded to at least the internal opposing faces of all the discs in the rotor assembly. Each vane was approximately 1.25 inches in width. The vanes or ribs were of equal length and terminated at the periphery of a circle of diameter between about 4.00 and 4.30 inches. The innermost end of each rib was tapered with a flattened end portion. The vanes were approximately 6 inches long.

In a specific example of a vaned disc pump having multiple thin vanes of the configuration illustrated in FIGS. 7 and 8, the discs were of 14 inch diameter and each disc in the rotor assembly had eighteen narrow ribs or vanes welded to at least its internal rotor faces. In this example, the vane thickness was of the order of 0.125 inches and the vane length was approximately 5 inches. In a two disc version of this pump, the arrangement was similar to that illustrated in FIGS. 2 or 4 but with a greater disc spacing and taller vanes than in the first embodiment. The height of each vane was no more than 25% of the spacing between the discs to maintain the desired vane separation In each of the vane configurations illustrated in the drawings, straight radial vanes or ribs are provided which extend from the outer periphery of the disc up to a location relatively close to the center of the disc. Preferably, the vane length is at least 70% of the disc radius The ribs may be of generally rectangular cross-section as shown, although other cross-sectional shapes may be used. Any number of vanes from 4,6,8 to 18 or more may be used, with the vanes being thinner as their number increases. Preferably, the vane width is between 0.125 and 1.25 inches. The vanes on opposing disc faces of adjacent pairs of discs are preferably aligned, although in some cases an offset between the opposing vanes may be provided This would reduce efficiency, however.

Although in most cases it is preferable to provide vanes on the opposing inner faces of each pair of adjacent discs in the pump, the provision of vanes on only one of the opposing faces of each pair will also result in some improvement in efficiency, and provides greater clearances.

The vaned disc pump illustrated in the drawings has been found to produce increased pump efficiency approaching fifty or sixty percent or more over a comparably sized planar disc pump, depending on the vane configuration used. The vane structures are believed to enhance the efficiency of the rotating elements by adding to the profile or form passing through the material or fluid being pumped, resulting in increased form drag. At the same time, since the opposing vanes are spaced apart, there are no close fitting rotor parts subject to wear or abrasion, and which would be likely to clog in the case of certain materials. The vaned disc pump has a low risk of clogging and can handle stringy materials or large soft objects approaching pipe size. The efficiency of the pump is of course less than that of a conventional impeller type centrifugal pump, but this pump provides substantially improved material and solid handling, and greater pump stability than centrifugal pumps The conventional centrifugal pump has a backwards curved vane and utilizes lift forces to accelerate the fluid being pumped, which has certain disadvantages and can lead to operational instabilities and cavitation problems The straight vanes of the vaned disc pump, in contrast, do not generate lift forces The pump is extremely stable over a wide flow range and has very low cavitation sensitivity.

The vaned disc pump of this invention is particularly suitable for materials carrying entrained air or gas, which would be likely to cause cavitation in centrifugal pumps, and for mid-range pump installations where the materials are not sufficiently abrasive or shear sensitive to warrant use of a planar disc pump but are likely to cause unacceptable life or performance in a conventional centrifugal pump This pump is also useful for applications where rapid changes in flow conditions are experienced.

Although some preferred embodiments of the invention have been described above by way of example only, it will be understood by those skilled in the field that modifications may be made to the described embodiments without departing from the scope of the invention, which is defined by the appended claims.

I claim:

1. A rotary disc pump, comprising:

a housing having an inner cylindrical rotor chamber;

an inlet at one end of said chamber;

an outlet communicating with the outer periphery of said chamber;

an impeller shaft rotatably mounted at one end of said chamber;

at least two parallel, spaced discs disposed co-axially in said rotor chamber and connected together for rotation about their center axis, one of said discs comprising a drive disc mounted on said impeller shaft;

the inner opposing faces of said discs being spaced a predetermined distance apart; and a plurality of raised vanes mounted on at least one of said opposing faces, the height of the vanes being less than the spacing between the discs.

2. The pump as claimed in claim 1, including raised vanes on each of said opposing disc faces, the combined height of the vanes being less than the spacing between the discs so that the opposing vanes are spaced apart.

3. The pump as claimed in claim 2, wherein the vanes comprise straight, radially extending ribs extending at spaced intervals around the face of each disc.

4. The pump as claimed in claim 1, wherein a plurality of parallel spaced discs are disposed in said chamber, and the opposing inner faces of each adjacent pair of discs each have a plurality of raised vanes, the combined height of the opposing vanes being less than the disc spacing.

5. The pump as claimed in claim 1, wherein the disc at the opposite end of the chamber to the inlet comprises a drive plate, and the drive plate has raised vanes on both of its faces.

6. The pump as claimed in claim 2, wherein the discs at the opposite ends of the chamber have vanes on their outer and inner faces.

7. The pump as claimed in claim 2, wherein the vane height is no more than 25% of the disc spacing.

8. The pump as claimed in claim 2, wherein the vanes are tapered to a point at their inner ends.

9. The pump as claimed in claim 3, wherein the total number of vanes on each disc is between 6 and 18.

10. The pump as claimed in claim 3, wherein the length of each vane is at least 70% of the disc radius.

11. The pump as claimed in claim 3, wherein each vane extends from the outer periphery of each disc to a position spaced from the center of the disc.

12. The pump as claimed in claim 2, wherein the opposing vanes on the opposing disc faces are of substantially identical configuration and are aligned.

13. The pump as claimed in claim 3, wherein the vane width is in the range from 0.125 to 1.25 inches.

14. The pump as claimed in claim 3, wherein a series of 18 radial vanes of width 0.125 inches are provided on each of the opposing disc faces.

* * * * *